US007492100B2

(12) United States Patent
Kim

(10) Patent No.: US 7,492,100 B2
(45) Date of Patent: Feb. 17, 2009

(54) PLASMA DISPLAY PANEL HAVING OPTIMALLY POSITIONED DISCHARGE ELECTRODES

(75) Inventor: Woo-Tae Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 555 days.

(21) Appl. No.: 11/104,489

(22) Filed: Apr. 13, 2005

(65) Prior Publication Data

US 2005/0236990 A1 Oct. 27, 2005

(30) Foreign Application Priority Data

Apr. 27, 2004 (KR) ..... 10-2004-0029160

(51) Int. Cl.
*H01J 17/49* (2006.01)

(52) U.S. Cl. ..... 313/584; 313/582; 313/586; 313/587; 313/292

(58) Field of Classification Search ..... 313/582–587
See application file for complete search history.

(56) References Cited

U.S. PATENT DOCUMENTS 5,371,437 A * 12/1994 Amano ..... 315/169.1
5,541,618 A 7/1996 Shinoda
5,640,068 A * 6/1997 Amemiya ..... 313/582
5,661,500 A 8/1997 Shinoda et al.

(Continued)

FOREIGN PATENT DOCUMENTS

CN 1380676 11/2002

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Sikha Roy
(74) *Attorney, Agent, or Firm*—Robert E. Bushnell, Esq.

(57) ABSTRACT

A high efficiency plasma display panel (PDP) has a discharge cell structure in which front discharge electrodes and rear discharge electrodes are optimally positioned to maximize discharge efficiency and greatly increase light transmittance. The PDP includes: a transparent front substrate; a rear substrate arranged in parallel with the front substrate; front barrier ribs made of a dielectric material and located between the front substrate and the rear substrate so as to define discharge cells together with the front substrate and the rear substrate; front discharge electrodes located in the front barrier ribs such that they surround the discharge cells and are separated from the front substrate; rear discharge electrodes located in the front barrier ribs such that they surround the discharge cells and are separated from the front discharge electrodes; rear barrier ribs located between the front barrier ribs and the rear substrate so as to define the discharge cells together with the front barrier ribs, the front substrate and the rear substrate; fluorescent layers located in spaces defined by the rear barrier ribs and the rear substrate; and a discharge gas deposited in the discharge cells.

16 Claims, 10 Drawing Sheets

U.S. PATENT DOCUMENTS

| | | | | |
|---|---|---|---|---|
| 5,663,741 | A | 9/1997 | Kanazawa | |
| 5,674,553 | A | 10/1997 | Shinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,756,733 | B2 * | 6/2004 | Kim et al. | 313/587 |
| 7,015,643 | B2 * | 3/2006 | Kweon | 313/583 |
| 7,279,837 | B2 | 10/2007 | Kwon et al. | |
| 7,312,576 | B2 * | 12/2007 | Yoo | 313/584 |
| 2002/0017863 | A1 * | 2/2002 | Kim et al. | 313/586 |
| 2002/0135545 | A1 * | 9/2002 | Akiba | 345/60 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |

OTHER PUBLICATIONS

*Office action* from the Chinese Patent Office issued in Applicant's corresponding Chinese Patent Application No. 200510076205.9 dated Oct. 10, 2008.

* cited by examiner

PLASMA DISPLAY PANEL HAVING OPTIMALLY POSITIONED DISCHARGE ELECTRODES

CLAIM OF PRIORITY

This application makes reference to, incorporates the same herein, and claims all benefits accruing under 35 U.S.C. §119 from an application entitled PLASMA DISPLAY PANEL filed with the Korean Industrial Property Office on 27 Apr. 2004 and there duly assigned Serial No. 2004-0029160.

BACKGROUND OF THE INVENTION

1. Technical Field

The present invention relates to a plasma display panel (PDP) and, more particularly, to a PDP in which front discharge electrodes and rear discharge electrodes are optimally positioned.

2. Related Art

A plasma display panel (PDP) comprises a front panel and a rear panel. The front panel comprises a front substrate, pairs of sustain electrodes composed of Y electrodes and X electrodes disposed on the rear surface of the front substrate, a front dielectric layer covering the sustain electrodes, and a protective layer covering the front dielectric layer.

Each of the Y electrodes is composed of a transparent electrode and a bus electrode, and each of the X electrodes is composed of a transparent electrode and a bus electrode. The transparent electrodes are made of indium tin oxide (ITO) or the like. The bus electrodes and are made of highly conductive metal.

The rear panel comprises a rear substrate, address electrodes disposed on the front surface of the rear substrate and intersecting the pairs of sustain electrodes, a rear dielectric layer covering the address electrodes, barrier ribs on the rear dielectric layer dividing a discharge space into discharge cells, and fluorescent layers on the sidewalls of the barrier ribs and the rear dielectric layer.

In the PDP, in addition to the pairs of sustain electrodes which generate discharge, the front dielectric layer and the protective layer are formed on the rear surface of the front substrate through which visible light generated by the fluorescent layers in the discharge cells is transmitted. Thus, transmittance of visible light is remarkably reduced and the brightness of the PDP is reduced.

Furthermore, since the pairs of sustain electrodes are formed on the rear surface of the front substrate in the PDP, the majority of the sustain electrodes must be formed of ITO, which is very expensive and highly resistive, in order to allow the generated visible light to be transmitted through the front substrate.

Thus, the production cost of the PDP is increased. Furthermore, since the high resistance of the ITO electrodes causes a voltage drop, images cannot be uniformly displayed when the PDP is large.

In the PDP, the pairs of sustain electrodes are formed on the rear surface of the front substrate, and the discharge occurs behind the protective layer and diffuses within the discharge cells. In other words, the discharge occurs on only one of the surfaces of each of the discharge cells. Thus, luminous efficiency is reduced.

When the PDP is used for a long period of time, charged discharge gas induces ion sputtering of the fluorescent material in the fluorescent layers due to an electric field, resulting in permanent after-images.

In a unit discharge cell, a pair of sustain electrodes is covered with a front dielectric layer, and the front dielectric layer is covered with a protective layer. When a pulse potential is applied to the sustain electrodes, particles in the front dielectric layer are charged, thereby generating wall charge on the rear surface of the protective layer.

At this point, the pulse potential applied to the sustain electrodes generates an electric field component, perpendicular to the rear surface of the protective layer, from the flat surfaces of the sustain electrodes, and generates an electric field component, at an acute angle to the rear surface of the protective layer, from the edges of the sustain electrodes. Thus, charge is induced over a distance wider than the width of each of the sustain electrodes on the rear surface of the protective layer.

In this case, the electric field radiating from the edges of the sustain electrodes interferes with the barrier ribs, and thus the amount of wall charge on the rear surface of the protective layer is reduced. As a result, the level of discharge at a given drive voltage is reduced, and thus power efficiency of the PDP is reduced.

SUMMARY OF THE INVENTION

The present invention provides a plasma display panel (PDP) in which front discharge electrodes and rear discharge electrodes are optimally positioned.

According to an aspect of the present invention, there is provided a PDP comprising: a transparent front substrate; a rear substrate arranged in parallel with the front substrate; front barrier ribs made of a dielectric material and located between the front substrate and the rear substrate to define discharge cells together with the front substrate and the rear substrate; front discharge electrodes located in the front barrier ribs so as to surround the discharge cells and separated from the front substrate; rear discharge electrodes located in the front barrier ribs so as to surround the discharge cells and separated from the front discharge electrodes; rear barrier ribs located between the front barrier ribs and the rear substrate so as to define the discharge cells together with the front barrier ribs, the front substrate, and the rear substrate; fluorescent layers located in spaces defined by the rear barrier ribs and the rear substrate; and a discharge gas in the discharge cells.

The front discharge electrodes may be located such that an angle $\theta_a$ between a first front line and a second front line is 0-75°, wherein the first front line is the shortest line connecting the front edge of the outer sidewall of the front barrier rib to the front edge of the outer sidewall of the front discharge electrode, and the second front line is the shortest line connecting the outer sidewall of the front discharge electrode to the outer sidewall of the front barrier rib. Preferably, the front discharge electrode is located such that the angle $\theta_a$ is 46-61°.

The rear discharge electrodes may be located such that an angle $\theta_b$ between a first rear line and a second rear line is 0-61°, wherein the first rear line is the shortest line connecting the rear edge of the outer sidewall of the front barrier rib to the rear edge of the outer sidewall of the rear discharge electrode, and the second rear line is the shortest line connecting the outer sidewall of the rear discharge electrode to the outer sidewall of the front barrier rib. Preferably, the rear discharge electrodes are located such that the angle $\theta_b$ is 10-36°.

The front discharge electrodes and the rear discharge electrodes may be located such that an angle $\theta_a$ between a first front line and a second front line is greater than or equal to an angle $\theta_b$ between a first rear line and a second rear line, wherein the first front line is the shortest line connecting the front edge of the outer sidewall of the front barrier rib to the front edge of the outer sidewall of the front discharge electrode, the second front line is the shortest line connecting the outer sidewall of the front discharge electrode to the outer sidewall of the front barrier rib, the first rear line is the shortest line connecting the rear edge of the outer sidewall of the front barrier rib to the rear edge of the outer sidewall of the rear discharge electrode, and the second rear line is the shortest line connecting the outer sidewall of the rear discharge electrode to the outer sidewall of the front barrier rib.

The PDP may further comprise rear protective layers located on the front surfaces of the fluorescent layers.

The front discharge electrodes may extend in a predetermined direction, and the rear discharge electrodes may extend so as to cross the front discharge electrodes at the discharge cells.

The front discharge electrodes and the rear discharge electrodes may extend in a predetermined direction, and address electrodes may extend so as to cross the front discharge electrodes and the rear discharge electrodes at the discharge cells. The address electrodes may be interposed between the rear substrate and the fluorescent layers, and a dielectric layer may be interposed between the fluorescent layers and the address electrodes.

Each of the front discharge electrodes and the rear discharge electrodes may have a ladder shape, and at least the outer sidewalls of the front barrier ribs may be coated with a protective layer.

When the outer sidewalls of the front barrier ribs are coated with the protective layer, the front discharge electrodes and the rear discharge electrodes may be located such that an angle $\theta_a$ between a first front line and a second front line is 0-75°, an angle $\theta_b$ between a first rear line and a second rear line is 0-61°, and the angle $\theta_a$ is greater than or equal to the angle $\theta_b$, wherein the first front line is the shortest line connecting the front edge of the outer sidewall of the front barrier rib to the front edge of the outer sidewall of the front discharge electrode, the second front line is the shortest line connecting the outer sidewall of the front discharge electrode to the outer sidewall of the front barrier rib, the first rear line is the shortest line connecting the rear edge of the outer sidewall of the front barrier rib to the rear edge of the outer sidewall of the rear discharge electrode, and the second rear line is the shortest line connecting the outer sidewall of the rear discharge electrode to the outer sidewall of the front barrier rib.

The front discharge electrodes and the rear discharge electrodes may be located such that the angle $\theta_a$ is 46-61°, the angle $\theta_b$ is 10-36°, and the angle $\theta_a$ is greater than or equal to the angle $\theta_b$.

The front barrier ribs and the rear barrier ribs may be formed as an integrated body.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, plasma display panels (PDPs) according to embodiments of the present invention will be described in more detail with reference to the attached drawings.

Figure 1:
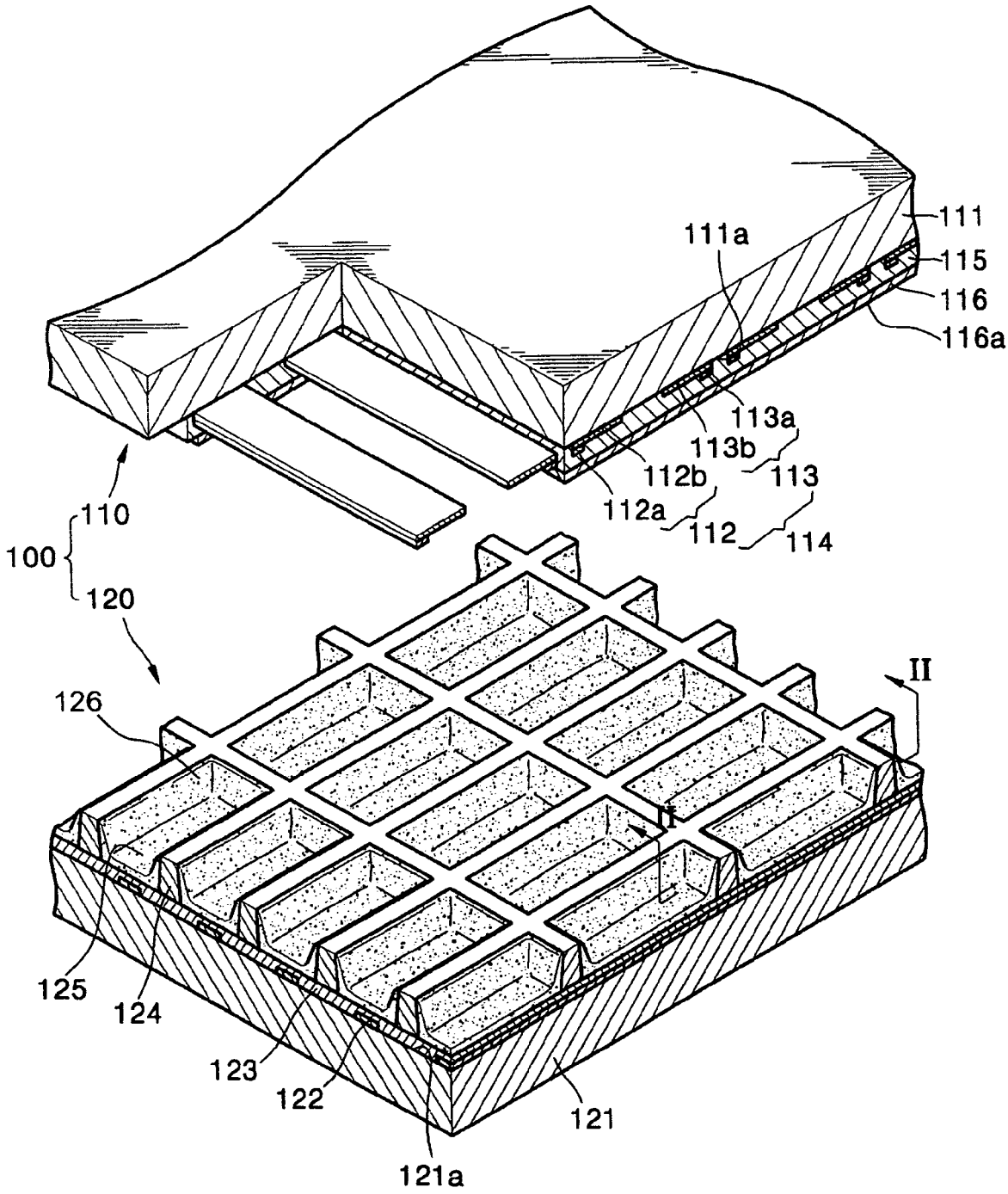
FIG. 1 (Conventional Art)
FIG. 1 is a partially cutaway exploded perspective view of a portion of a PDP.

FIG. 1 is a partially cutaway exploded perspective view of a portion of a PDP, specifically, an alternating current, triode-type, surface discharge PDP.

Referring to FIG. 1, the PDP 100 comprises a front panel 110 and a rear panel 120. The front panel 110 comprises a front substrate 111, pairs of sustain electrodes 114 composed of Y electrodes 112 and X electrodes 113 disposed on the rear surface 111*a* of the front substrate 111, a front dielectric layer 115 covering the sustain electrodes 114, and a protective layer 116 covering the front dielectric layer 115.

Each of the Y electrodes 112 is composed of a transparent electrode 112*b* and a bus electrode 112*a*, and each of the X electrodes 113 is composed of a transparent electrode 113*b* and a bus electrode 113*a*. The transparent electrodes 112*b* and 113*b* are made of indium tin oxide (ITO) or the like. The bus electrodes 112*a* and 113*b* are made of highly conductive metal.

The rear panel 120 comprises a rear substrate 121, address electrodes 122 disposed on the front surface of the rear substrate 121 and intersecting the pairs of sustain electrodes 114, a rear dielectric layer 123 covering the address electrodes 122, barrier ribs 124 disposed on the rear dielectric layer 123 and dividing a discharge space into discharge cells 126, and fluorescent layers 125 disposed on the sidewalls of the barrier ribs 124 and the rear dielectric layer 123.

In the PDP 100, in addition to the pairs of sustain electrodes 114 which generate discharge, the front dielectric layer 115 and the protective layer 116 are formed on the rear surface 111*a* of the front substrate 111 through which visible light generated by the fluorescent layers 125 in the discharge cells 126 is transmitted. Thus, transmittance of visible light is remarkably reduced, and the brightness of the PDP 100 is reduced.

Further, since the pairs of sustain electrodes 114 are formed on the rear surface 111*a* of the front substrate 111 in the PDP 100, the majority of the sustain electrodes 114 must be formed of ITO, which is very expensive and highly resistive, in order to allow the generated visible light to be transmitted through the front substrate 111.

Thus, the production cost of the PDP 100 is increased. Furthermore, since the high resistance of the ITO electrodes causes a voltage drop, images cannot be uniformly displayed when the PDP 100 is large.

In the PDP 100, the pairs of sustain electrodes 114 are formed on the rear surface 111*a* of the front substrate 111, and the discharge occurs behind the protective layer 116 and diffuses within the discharge cells 126. In other words, the discharge occurs on only one of the surfaces of each of the discharge cells 126. Thus, luminous efficiency is reduced.

When the PDP 100 is used for a long period of time, charged discharge gas induces ion sputtering of the fluorescent material in the fluorescent layers 125 due to an electric field, resulting in permanent after-images.

Figure 2:
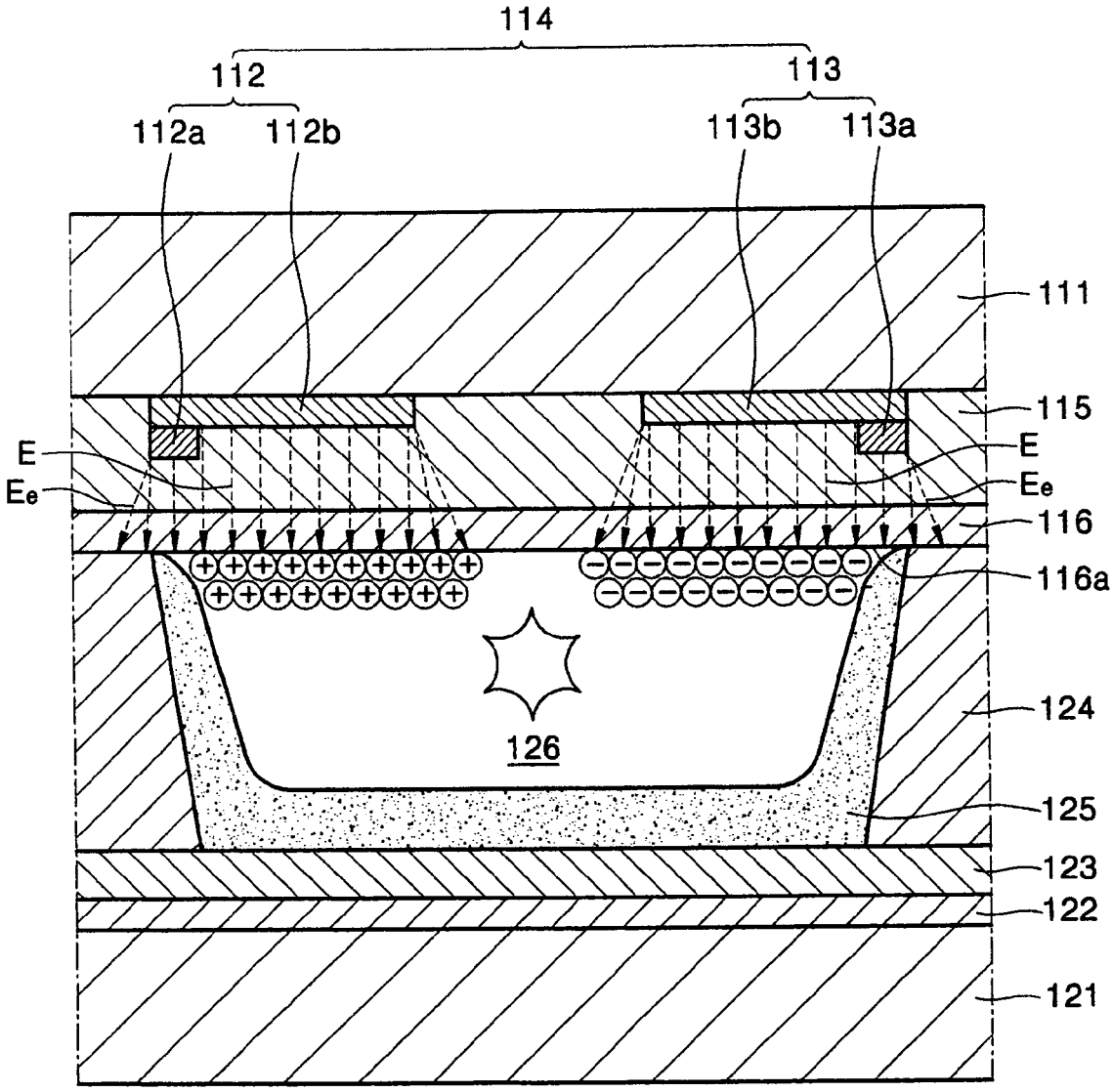
FIG. 2 (Conventional Art)
FIG. 2 is a cross-sectional view taken along line II-II of the PDP illustrated in FIG. 1, showing the distribution of wall charges.

FIG. 2 is a cross-sectional view taken along line II-II of the PDP 100 illustrated in FIG. 1, showing the distribution of wall charges.

Referring to FIG. 2, in a unit discharge cell 126, a pair of sustain electrodes 114 is covered with a front dielectric layer 115, and the front dielectric layer 115 is covered with a protective layer 116. When a pulse potential is applied to the sustain electrodes 114, particles in the front dielectric layer 115 are charged, thereby generating wall charges on the rear surface 116*a* of the protective layer 116.

At this point, the pulse potential applied to the sustain electrodes 114 generates an electric field component E, perpendicular to the rear surface 116*a* of the protective layer 116, from the flat surfaces of the sustain electrodes 114, and generates an electric field component $E_e$, at an acute angle to the rear surface 116*a* of the protective layer 116, from the edges of the sustain electrodes 114. Thus, charge is induced over a distance wider than the width w of each of the sustain electrodes 114 on the rear surface 116*a* of the protective layer 116.

In this case, the electric field $E_e$ radiating from the edges of the sustain electrodes 114 interferes with the barrier ribs 124, and thus the amount of wall charge on the rear surface 116*a* of the protective layer 116 is reduced. As a result, the level of discharge at a given drive voltage is reduced, and thus, the power efficiency of the PDP 100 is reduced.

Figure 3A:
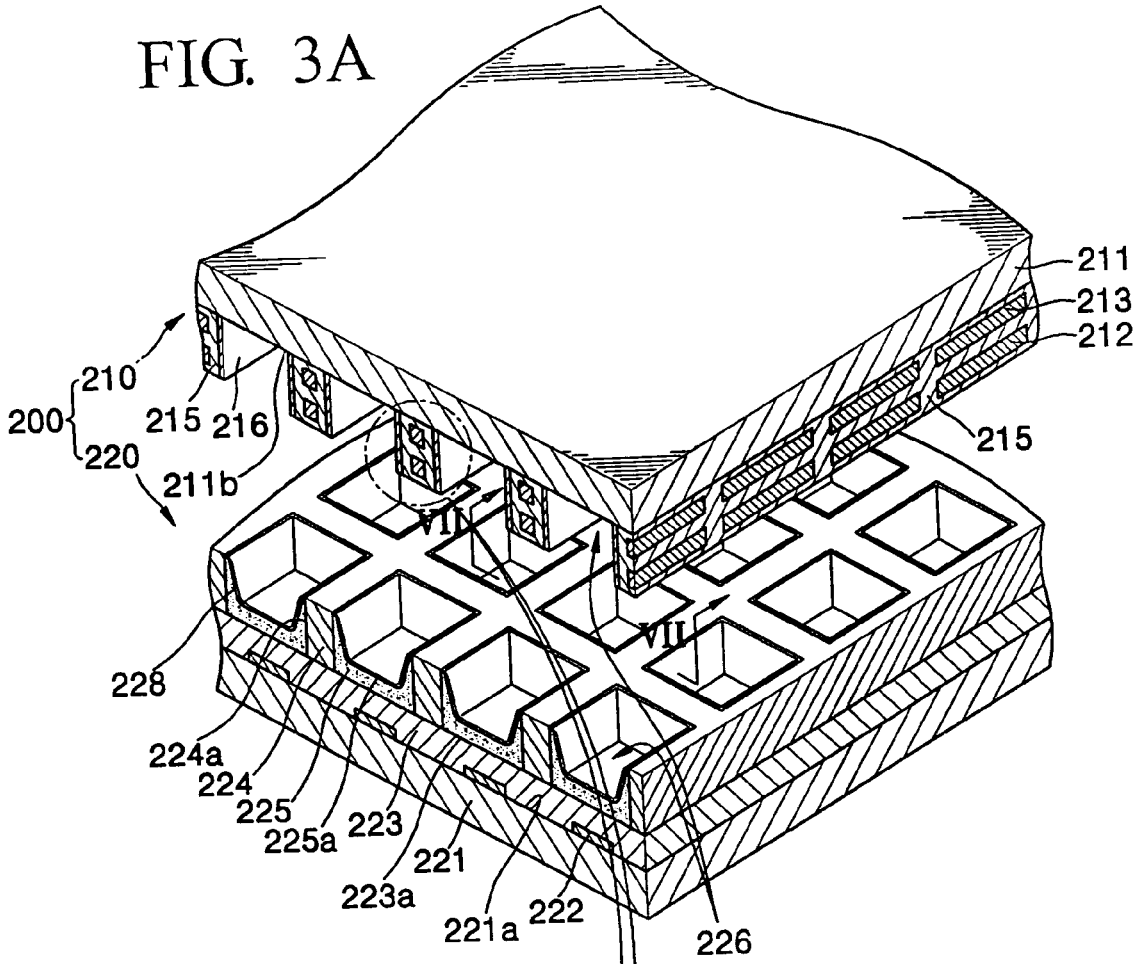
FIGS. 3A and 3B together form an exploded perspective view of a portion of a PDP according to an embodiment of the present invention.
Figure 3B:
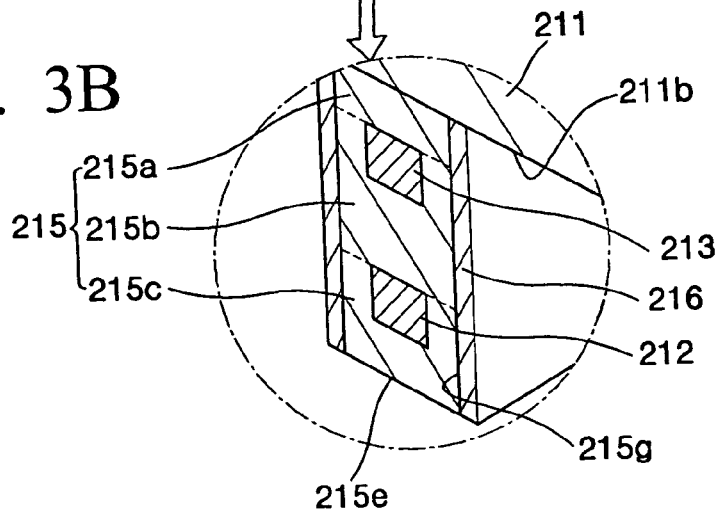

FIGS. 3A and 3B together form an exploded perspective view of a portion of a PDP according to an embodiment of the present invention.

Referring to FIG. 3A, the PDP 200 comprises a front panel 210 and a rear panel 220. The front panel 210 comprises a transparent front substrate 211, and the rear panel 220 comprises a rear substrate 221 parallel to and facing the front panel 210.

Front barrier ribs 215 are located on the rear surface 211*b* of the front substrate 211 so as to define discharge cells 226 together with the front substrate 211, the rear substrate 221, and rear barrier ribs 224 (described below).

The front panel 210 comprises front discharge electrodes 213 and rear discharge electrodes 212. The front discharge electrodes 213 are located in the front barrier ribs 215 so as to surround the discharge cells 226, and are separated from the front substrate 211. The rear discharge electrodes 212 are located in the front barrier ribs 215 so as to surround the discharge cells 226, and are separated from the front discharge electrodes 213. The rear discharge electrodes 212 extend parallel to the front discharge electrodes 213 in a predetermined direction. The front panel 210 may further comprise protective layers 216 covering the outer sidewalls 215*g* of the front barrier ribs 215. The positions of the front discharge electrodes 213 and the rear discharge electrodes 212 in the front barrier ribs 215 will be described later.

The rear panel 220 comprises the rear substrate 221, address electrodes 222 located on the front surface 221*a* of the rear substrate 221 and extending so as to cross the front discharge electrodes 213 and the rear discharge electrodes 212, a dielectric layer 223 covering the address electrodes 222, rear barrier ribs 224 located on the dielectric layer 223, fluorescent layers 225 located in spaces defined by the rear barrier ribs 224 and the rear substrate 221, and rear protective layers 228 covering the front surfaces 225*a* of the fluorescent layers 225.

The front panel 210 and the rear panel 220 are combined with each other using a combination member, such as a frit (not shown), and sealed. The discharge cells 226 are filled with a discharge gas, such as Xe, Ne, He, Ar or a mixture thereof.

The front substrate 211 and the rear substrate 221 are generally made of glass. The front substrate 211 may be made of a material having a high light transmittance. The PDP 200 does not include elements of the PDP 100 illustrated in FIG. 1, such as the sustain electrodes 114 on the rear surface 111*b* of the front substrate 111, the front dielectric layer 115 covering the sustain electrodes 114, and the protective layer 116 covering the front dielectric layer 115, in a portion of the rear surface 211*b* of the front substrate 211, which defines the discharge cells 226.

Thus, unlike the PDP 100, the visible light generated by the fluorescent layers 225 is transmitted through only the transparent front substrate 211, which has a high light transmittance, thereby greatly increasing forward transmittance.

In order to increase brightness of the PDP 200, a reflective layer (not shown) may be located on the front surface 221*a* of the rear substrate 221 or on the front surface 223*a* of the dielectric layer 223, or a light reflective material may be contained in the dielectric layer 223 such that the visible light generated by the fluorescent layers 225 is efficiently reflected forward.

In the alternating current, triode-type, surface discharge PDP 100, in order to increase the light transmittance, the discharge electrodes are made of ITO, which has a relatively high resistance. However, in the PDP 200 illustrated in FIG. 3, the front discharge electrodes 213 and the rear discharge electrodes 212 can be made of inexpensive materials which have high electrical conductivity, such as Ag, Cu, Cr, etc., regardless of light transmittance.

The front barrier ribs 215 are located on the rear surface 211*b* of the front substrate 211 so as to define the discharge cells 226 together with the front substrate 211, the rear substrate 221, and rear barrier ribs 224. The discharge cells 226 are formed into a matrix shape by the front barrier ribs 215 in FIG. 3B, but are not limited thereto, and may have a honeycomb or delta shape.

The cross-sections of the discharge cells 226 are rectangular in FIG. 3A, but are not limited thereto, and may be polygonal (for example, triangles, pentagons, circular, oval, etc.).

The front discharge electrodes 213 and the rear discharge electrodes 212 are located in the front barrier ribs 215 so as to surround the discharge cells 226. Positioning of the front discharge electrodes 213 and the rear discharge electrodes 212 in the front barrier ribs 215 will be explained by an example with reference to the enlarged view of FIG. 3B.

Referring to FIG. 3B, a first front barrier rib layer 215*a* is formed on the rear surface 211*b* of the front substrate 211. Then, a front discharge electrode 213 is formed on the first front barrier rib layer 215*a*, and a second front barrier rib layer 215*b* is formed to cover the front discharge electrode 213. Next, a rear discharge electrode 212 is formed on the second front barrier rib layer 215*b*, and a third front barrier rib layer

215*c* is formed to cover the rear discharge electrode 212. The first, second, and third front barrier rib layers 215*a*, 215*b*, and 215*c* may be made of dielectric materials, such as glass containing elements such as Pb, B, Si, Al, and O, and if necessary, a filler such as $ZrO_2$, $TiO_2$, and $Al_2O_3$ and a pigment such as Cr, Cu, Co, Fe, $TiO_2$. When a pulse potential is applied between the front discharge electrode 213 and the rear discharge electrode 212, such dielectric materials induce charged particles, and thus induce the wall charges which participate in the discharge and protect the front discharge electrodes 213 and the rear discharge electrodes 212.

The thicknesses of the first, second, and third front barrier rib layers 215*a*, 215*b*, and 215*c* can be determined according to an angle $\theta_a$ and an angle $\theta_b$, and the production of the first, second, and third front barrier rib layers 215*a*, 215*b*, and 215*c* can be repeated or omitted to obtain the necessary thicknesses.

After the front barrier rib 215 is formed, the protective layer 216 may be formed on the outer sidewall 215*g* of the front barrier rib 215 by deposition or the like. The protective layer 216 protects the front discharge electrode 213, the rear discharge electrode 212, and the front barrier rib 215, and emits secondary electrons during the discharge, thereby allowing the discharge to be easily generated.

During the formation of the protective layer 216, a protective layer may be further formed on the rear surface 211*b* of the front substrate 211 and on the rear surface 215*g* of the front barrier rib 215. The protective layer thus formed does not have an adverse effect on the operation of the PDP 200.

Rear barrier ribs 224 may be formed on the dielectric layer 223. The rear barrier ribs 224 may be made of dielectric materials, such as glass containing elements such as Pb, B, Si, Al, and O, and if necessary, a filler such as $ZrO_2$, $TiO_2$, and $Al_2O_3$ and a pigment such as Cr, Cu, Co, Fe, $TiO_2$, as in the front barrier ribs 215.

The rear barrier ribs 224 define spaces in which the fluorescent layers 225 are coated and, together with the front barrier ribs 215, resist the force of the vacuum (for example, 0.5 atm) of the discharge gas inserted between the front panel 210 and the rear panel 220. The rear barrier ribs 224 also define spaces for the discharge cells 226, and prevent cross-talk between the discharge cells 226.

The rear barrier ribs 224 may contain a reflective material to reflect the visible light generated in the discharge cells 226 forward. The fluorescent layers 225, which emit red, green, or blue light, may be located in the spaces defined by the rear barrier ribs 224. The fluorescent layers 225 are divided by the rear barrier ribs 224.

The fluorescent layers 225 are formed by coating a fluorescent paste, comprising either red, green, or blue light-emitting fluorescent material, a solvent, and a binder, on the front surface 221*a* of the rear substrate 221 and the outer sidewalls 224*a* of the rear barrier ribs 224, and by drying and baking the resultant structure. The red light-emitting fluorescent material may be $Y(V,P)O_4$:Eu, etc., the green light-emitting fluorescent material may be $ZnSiO_4$:Mn, $YBO_3$:Tb, etc. and the blue light-emitting fluorescent material may be BAM:Eu, etc.

The rear protective layers 228 are made of MgO, for example, and may be formed on the front surfaces 225*a* of the fluorescent layers 225. When the discharge occurs in the discharge cells 226, the rear protective layers 228 can prevent deterioration of the fluorescent layers 225 due to collisions of the discharge particles and emit secondary electrons, thereby allowing the discharge to be easily generated.

Figure 4:
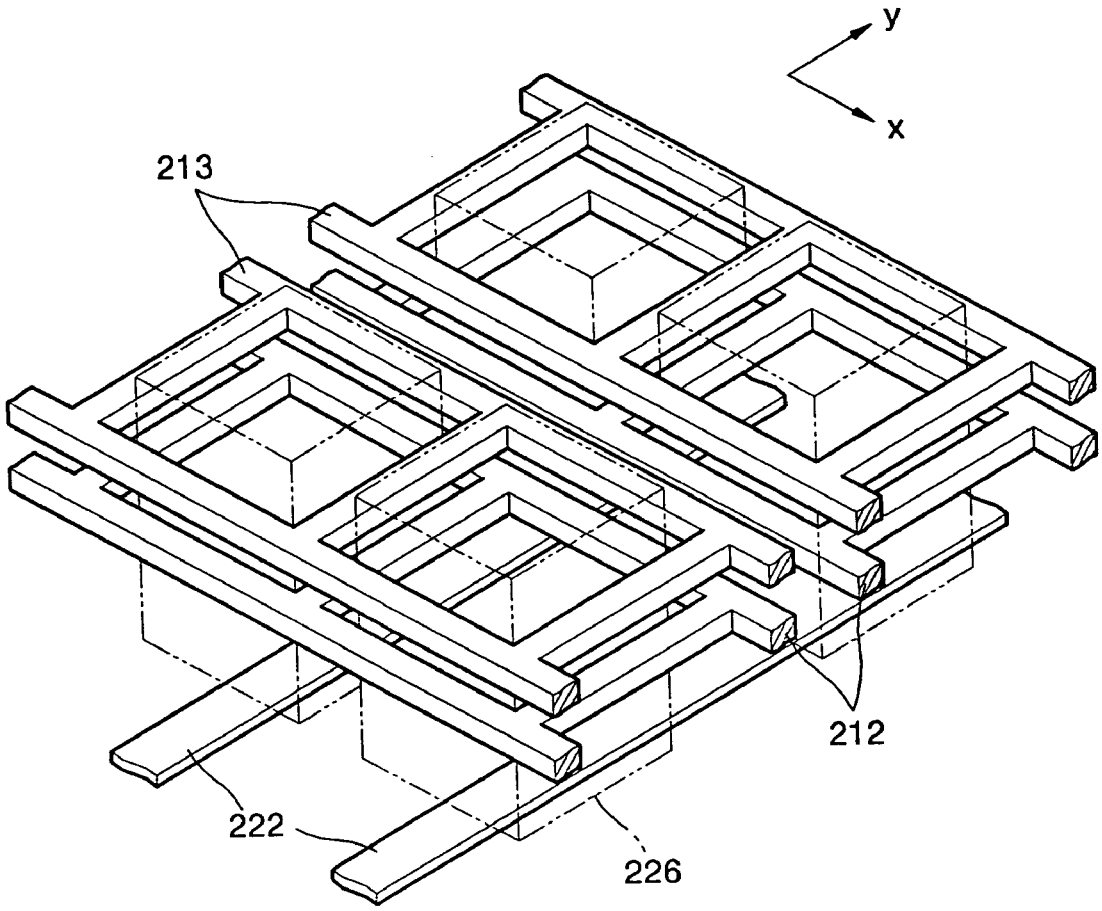
FIG. 4 illustrates front discharge electrodes, rear discharge electrodes, address electrodes, and discharge cells of the PDP illustrated in FIGS. 3A and 3B.

FIG. 4 illustrates front discharge electrodes, rear discharge electrodes, address electrodes, and discharge cells of the PDP illustrated in FIGS. 3A and 3B.

Referring to FIG. 4, each of the front discharge electrodes 213 and the rear discharge electrodes 212 has a ladder shape and extends in parallel with the x-axis direction. The address electrodes 222 extend in the y-axis direction, crossing the front discharge electrodes 213 and the rear discharge electrodes 212.

Since the rear discharge electrodes 212 are close to the address electrodes 222, an address discharge for selecting one of the discharge cells 226 in which a sustain discharge is to occur preferably occurs between the rear discharge electrodes 212 and the address electrodes 222. The rear discharge electrodes 212 may be common electrodes and the front discharge electrodes 213 may be scan electrodes, but the invention is not limited thereto.

The operation of the PDP 200 illustrated in FIGS. 3A and 3B will now be explained briefly by an example.

When a predetermined address potential is applied between the address electrodes 222 and the rear discharge electrodes 212, one of the discharge cells 226 to be lighted is selected, and wall charges accumulate on the sidewalls of the front barrier ribs 215, in which the rear discharge electrodes 212 are located, in the selected discharge cell 226.

Then, when a high pulse potential is applied to the front discharge electrodes 213 and a low pulse potential is applied to the rear discharge electrodes 212, the wall charges move due to the potential difference, and they collide with discharge gas atoms, thereby generating discharge and creating plasma. The discharge occurs more easily where the front discharge electrodes 213 are close to the rear discharge electrodes 212 since a stronger electric field is formed there.

In contrast to the alternating current, triode-type, surface discharge PDP 100 of FIG. 1, in which the discharge occurs mainly behind the front dielectric layer 115 (that is, on the rear surface 116*a* of the protective layer 116), in the PDP 200 illustrated in FIG. 3, an electric field is generated along the sidewalls surrounding the discharge cells 226, where the front discharge electrodes 213 are close to the rear discharge electrodes 212, and thus, the discharge is generated more easily and over a greater area, compared to the case of the PDP 100 of FIG. 1.

When the potential difference between the front discharge electrodes 213 and the rear discharge electrodes 212 is maintained for a predetermined time, the electric field generated on the sidewalls of the discharge cells 226 is concentrated on the central portions of the discharge cells 226. Thus, the discharge region is much larger than in the PDP 100 of FIG. 1, thereby increasing the amount of UV light generated by the discharge. Furthermore, since the discharge diffuses from the walls of the discharge cells 126 to the centers, ion collision with the fluorescent layers 225 is inhibited, and thus ion sputtering is prevented.

Although some ions are directed toward the fluorescent layers 225 during the discharge, the rear protective layers 228 prevent the ions from directly colliding with the fluorescent layers 225, thereby preventing deterioration of the fluorescent layers 225. Thus, the lifetime of the fluorescent layers 225 is extended.

When the potential difference between the front discharge electrodes 213 and the rear discharge electrodes 212 becomes lower than the firing voltage after the discharge, the discharge is no longer generated, and space charges and wall charges accumulate in the discharge cells 226. At this point, when a pulse potential of the opposite polarity is applied between the front discharge electrodes 213 and the rear discharge electrodes 212, the potential difference reaches the firing voltage with the aid of the wall charges, and a discharge is generated again.

When the polarity of the pulse potential between the front discharge electrodes 213 and the rear discharge electrodes 212 is repeatedly inverted, the discharge is maintained. The UV light generated by the discharge is transmitted through the rear protective layers 228 and strikes the fluorescent layers 225, thereby exciting fluorescent molecules in the fluorescent layers 225. When the energy level of the excited fluorescent molecules drops, visible light of a predetermined wavelength is generated, thereby displaying images.

Figure 5:
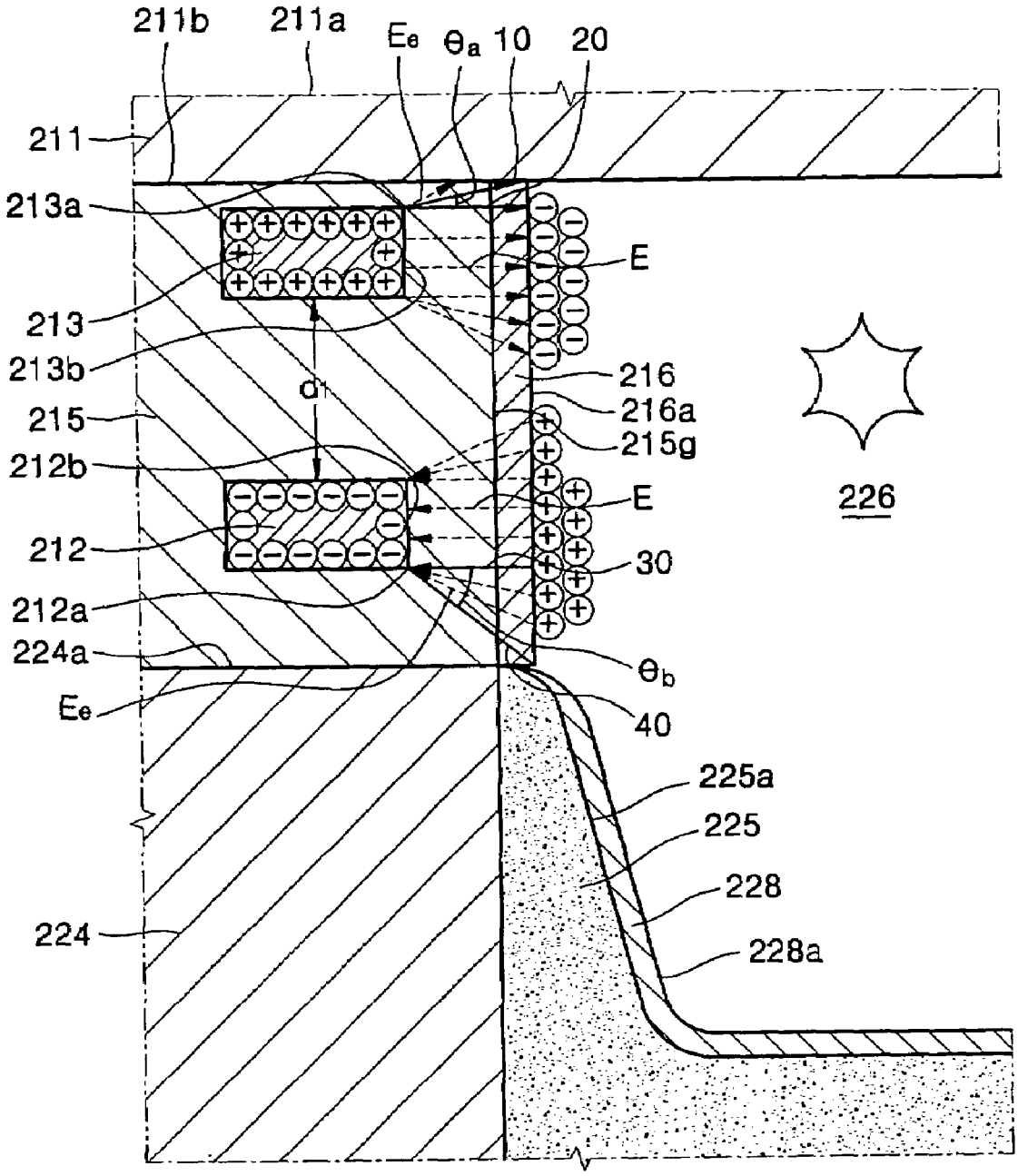
FIG. 5 is a cross-sectional view of a portion of the PDP illustrated in FIGS. 3A and 3B showing the distribution of wall charges and an electric field when $\theta_a$ decreases and $\theta_b$ increases.
Figure 6:
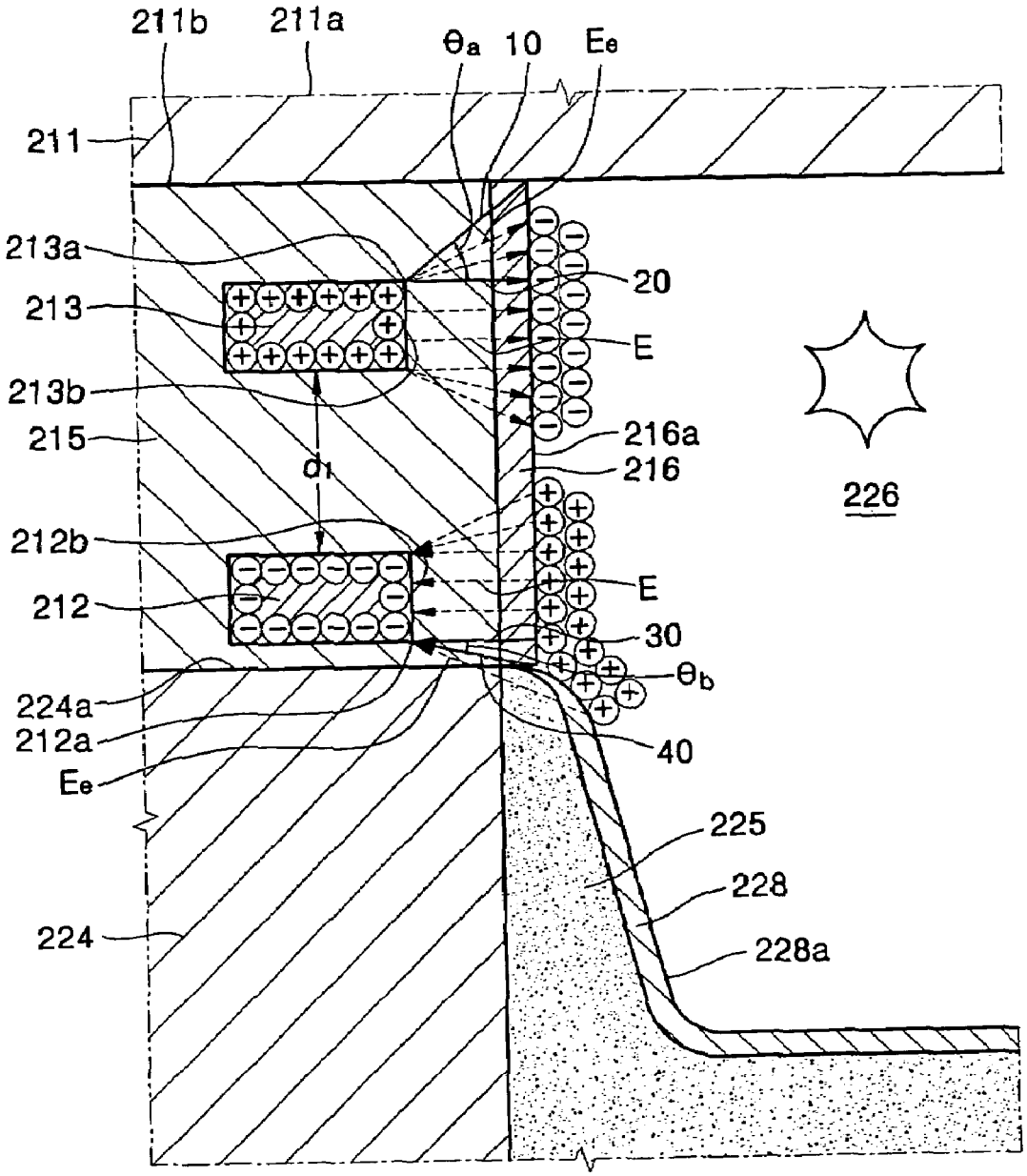
FIG. 6 is a cross-sectional view of a portion of the PDP illustrated in FIGS. 3A and 3B showing the distribution of wall charges and an electric field when $\theta_a$ increases and $\theta_b$ decreases.

FIG. 5 is a cross-sectional view of a portion of the PDP illustrated in FIGS. 3A and 3B, showing the distribution of wall charges and an electric field when $\theta_a$ decreases and $\theta_b$ increases, while FIG. 6 is a cross-sectional view of a portion of the PDP illustrated in FIGS. 3A and 3B, showing the distribution of wall charges and an electric field when $\theta_a$ increases and $\theta_b$ decreases.

Referring to FIGS. 5 and 6, the position of the front discharge electrode 213 and the rear discharge electrode 212 in a front barrier rib 215 will be now described. When a predetermined pulse potential is applied between the front discharge electrode 213 and the rear discharge electrode 212, an electric field E is generated from the outer sidewall 213*b* of the front discharge electrode 213 and the outer sidewall 212*b* of the rear discharge electrode 212, except for the edges 213*a* and 212*a* of the front discharge electrode 213 and the rear discharge electrode 212, in a direction perpendicular to the outer sidewall 216*a* of the protective layer 216.

Then, wall charges are accumulated on the outer sidewall 216*a* of the protective layer 216 by the electric field. As described above, when pulses of different potentials are applied between the front discharge electrode 213 and the rear discharge electrode 212, a potential difference between them is generated, and the wall charges move to collide with the discharge gas atoms in the discharge cell 226. Thus, the discharge gas is excited, and generates a discharge.

Accordingly, as the amount of wall charge increases, the probability that the wall charges will collide with the discharge gas increases, thereby increasing the probability of discharge. As a result, the amount of wall charge generated at a given drive voltage increases, thereby increasing the level of discharge. Due to the increased discharge, the amount of UV light generated by the discharge increases, and thus the amount of visible light generated by the fluorescent layers increases and the brightness of the PDP 200 is increased. Since the drive voltage of the PDP can be reduced while maintaining the required level of brightness, the electrical efficiency of the PDP 200 can be increased.

The front discharge electrode 213 and the rear discharge electrode 212 should be positioned such that the amount of wall charge that accumulates on the outer sidewall 216*a* of the protective layer 216 is increased by controlling the electric field generated by the potential applied between the front discharge electrode 213 and the rear discharge electrode 212.

First, the relationship between the position of the front discharge electrode 213 and the electric field caused by the pulse potential applied to the front discharge electrode 213, and the wall charge induced by the electric field, will be explained. An angle $\theta_a$ is defined as the angle between a first front line 10 and a second front line 20, wherein the first front line 10 is the shortest line connecting the front edge of the outer sidewall 216*a* of the protective layer 216 coated on the front barrier rib 215 to the front edge 213*a* of the outer sidewall 213*b* of the front discharge electrode 213, and the second front line 20 is the shortest line connecting the outer sidewall 213*b* of the front discharge electrode 213 to the outer sidewall 216*a* of the protective layer 216 coated on the front barrier rib 215.

When the protective layer 216 is not coated on the front barrier rib 215, the angle $\theta_a$ is measured based on the outer sidewall 215*g* of the front barrier rib 215, in place of the outer sidewall 216*a* of the protective layer 216.

As the angle $\theta_a$ is closer to 0°, the front discharge electrode 213 is closer to the rear surface 211*b* of the front substrate 211 when the range of the length of the second front line 20 is limited. An electric field E generated from the outer sidewall 213*b* of the front discharge electrode 213 is perpendicular to the outer sidewall 216*a* of the protective layer 216, and generates the wall charges on the outer sidewall 216*a* of the protective layer 216. However, an electric field Ee generated from the front edge 213*a* of the front discharge electrode 213 is angled toward the rear surface 211*b* of the front substrate 211, and thus it cannot generate wall charge on the outer sidewall 216*a* of the protective layer 216.

The electric field Ee has an effect on the front substrate 211, and thus the front substrate 211 functions as a dielectric layer, thereby generating charge in the air outside the discharge cell 226 and accumulating charge on the front surface 211*a* of the front substrate 211. The accumulated charge cannot contribute to discharge in the discharge cell 226, but instead may have an adverse effect on the PDP 200, for example, it may generate static electricity.

Referring to FIG. 6, when the angle $\theta_a$ is increased such that the front discharge electrode 213 is more distant from the rear surface 211*b* of the front substrate 211, the electric field Ee angled from the front edge 213*a* of the front discharge electrode 213 beneficially contributes to the wall charge on the outer sidewall 216*a* of the protective layer 216.

When the angle $\theta_a$ is increased, the wall charge is generated more to the rear of the outer sidewall 216*a* of the protective layer 216, than when the angle $\theta_a$ is 0°. Thus, the probability of generating discharge in the central portion of the discharge cell 226 is higher than when the angle $\theta_a$ is 0°.

When the discharge is generated in the central portion of the discharge cell 226, the discharge uniformly diffuses radially in the discharge cell 226, and thus the space in which the discharge can occur in the discharge cell 226 is enlarged. Thus, the amount of UV light generated by the discharge is increased.

As a result, more discharge is generated at a given drive voltage, and the electrical efficiency of the PDP 200 increases. Thus, the angle $\theta_a$ must be greater than 0°, i.e., the front discharge electrode 213 must be separated from the front substrate 211, based on the reasons as described above.

However, when the angle $\theta_a$ is too large, less of the electric field Ee angled from the edge 213*a* of the front discharge electrode 213 reaches the outer sidewall 216*a* of the protective layer 216 to contribute to the wall charge on the outer sidewall 216*a*. Thus, it cannot increase the discharge efficiency of the PDP 200. Considering this matter, the range of the angle $\theta_a$ is limited, and thus the distance between the front discharge electrodes 213 and the front substrate 211 is also limited.

If the angle $\theta_a$ is 0°, the electric field Ee has an effect only on the front substrate 211, and does not aid in accumulating wall charge on the outer sidewall 216*a* of the protective layer 216. Thus, in this case, the least amount of wall charge is generated.

As the angle $\theta_a$ increases from 0° to 75°, the amount of wall charge increases, and thus the level of discharge increases at a given drive voltage, and the electrical efficiency of the PDP 200 increases.

As the angle $\theta_a$ exceeds 75°, the distance between the front discharge electrode 213 and the rear surface 211*b* of the front substrate 211 increases, but the discharge efficiency does not increase. Although the angle $\theta_a$ increases, the distance between the front discharge electrode 213 and the front substrate 211 may not increase if the length of the second front line 20 decreases. However, since the range of the length of the second front line 20 is limited, the distance between the front discharge electrode 213 and the front substrate 211 increases.

That is, as the second front line 20 becomes shorter, the capacitance of the dielectric material between the front discharge electrode 213 and the inner sidewall of the protective layer 216 increases, and thus the amount of accumulated wall charge may increase. If the second front line 20 is too short, dielectric breakdown occurs in the dielectric material between the front discharge electrode 213 and the inner sidewall of the protective layer 216, consuming the wall charge accumulated on the inner sidewall of the protective layer 216, and thus discharge cannot occur. Thus, the range of the length of the second front line 20 is limited. As a result, it is reasonable that, as the angle $\theta_a$ increases, the distance between the front discharge electrode 213 and the front substrate 211 increases.

Considering the fact that the range of the length of the second front line 20 is limited, as the angle $\theta_a$ exceeds 75°, the thickness of the front barrier rib 215 increases without increasing the discharge efficiency. In this case, the volume of the discharge cell 226 becomes too large.

As the angle $\theta_a$ increases from 0° to 46°, the amount of wall charge generated on the outer sidewall 216*a* of the protective layer 216 by the electric field Ee angled from the front edge 213*a* of the front discharge electrode 213 increases, thereby maximizing the discharge efficiency. When the angle $\theta_a$ exceeds 61°, much less increase of the electrical efficiency can be gained. Based on these experimental results, the front discharge electrode 213 may be positioned such that the angle $\theta_a$ is 46-61°.

Referring to FIG. 6, the position of the rear discharge electrode 212 in the front barrier rib 215 will be now described. An angle $\theta_b$ is defined as the angle between a first rear line 40 and a second rear line 30, wherein the first rear line 40 is the shortest line connecting the rear edge of the outer sidewall 216*a* of the protective layer 216 coated on the front barrier rib 215 to the rear edge 212*a* of the outer sidewall 212*b* of the rear discharge electrode 212, and the second rear line 30 is the shortest line connecting the outer sidewall 212*b* of the rear discharge electrode 212 to the outer sidewall 216*a* of the protective layer 216 coated on the front barrier rib 215.

When the protective layer 216 is not coated on the front barrier rib 215, the angle $\theta_b$ is measured based on the outer sidewall 215*g* of the front barrier rib 215, in place of the outer sidewall 216*a* of the protective layer 216.

When the angle $\theta_b$ is 0°, the rear discharge electrode 212 comes in contact with the front surface 224*a* of the rear barrier rib 224. The rear barrier rib 224, which is made of glass containing elements such as Pb, B, Si, Al, and O, etc., can function as a dielectric material which induces the discharge of particles. Thus, although the rear discharge electrode 212 contacts the front surface 224*a*, when an electric field $E_e$ generated from the rear edge 212*a* of the rear discharge electrode 212 due to a pulse potential applied to the rear discharge electrode 212 is transmitted through a portion of the rear barrier rib 224 which functions as a dielectric material, the particles are charged, and thus, the wall charge accumulates at a portion of the front surface 228*a* of a rear protective layer 228 coated on the front surface 225*a* of the fluorescent layer 225.

Discharge efficiency does not decrease due to the wall charge accumulated on the front surface 228*a* of the rear protective layer 228 when the angle $\theta_b$ is 0°, unlike when the angle $\theta_a$ is 0°. Rather, as the angle $\theta_b$ is closer to 0°, there is a higher probability that the wall charge induced by the front discharge electrode 213 and the rear discharge electrode 212 in the discharge cell 226 is generated closer to the center of the discharge cell 226 on the outer sidewall 216*a* of the protective layer 216. Thus, the electrical efficiency of the PDP 200 can be increased, as described above.

The range of distance between the front discharge electrodes 213 and the front substrate 211 is limited, as described above. Moreover, the range of a distance d1 between the front discharge electrode 213 and the rear discharge electrode 212 is limited. The wall charge is accelerated by the electrical field generated by the potential applied between the front discharge electrode 213 and the rear discharge electrode 212. When the distance d1 increases, the intensity of the electric field accelerating the wall charge decreases, and the work energy of the accelerated wall charge is not enough to induce discharge. In this case, to achieve discharge, the drive voltage must be increased.

When the distance d1 decreases, the discharge due to the movement of the wall charge is generated in a narrow side portion in the discharge cell 226, and thus the volume of the discharge cell 226 cannot be efficiently used, and the discharge efficiency decreases.

Thus, the range of the distance d1 is limited. The range of the length of the second rear line 30 is limited for the same reason that the range of the length of the second front line 20 is limited. Since the position of the front discharge electrode 213, the range of the distance d1, and the range of the distance between the outer sidewall 212*b* of the rear discharge electrode 212 and the outer sidewall 216*a* of the protective layer 216 are limited as described above, the range of the distance between the rear discharge electrode 212 and the rear barrier rib 224 is limited accordingly.

Thus, the range of the angle $\theta_b$ is limited. According to experiments, when the angle $\theta_b$ exceeds 61°, the angle $\theta_a$ is undesirably close to 0° due to design limitations of the length of the second rear line 30, the distance d1, and the thickness of the front barrier rib 215.

Thus, the angle $\theta_b$ may be 0-61°. In order to optimize the distance d1 and the range of the angle $\theta_a$, the angle $\theta_b$ may be 10-36°.

Figure 7:
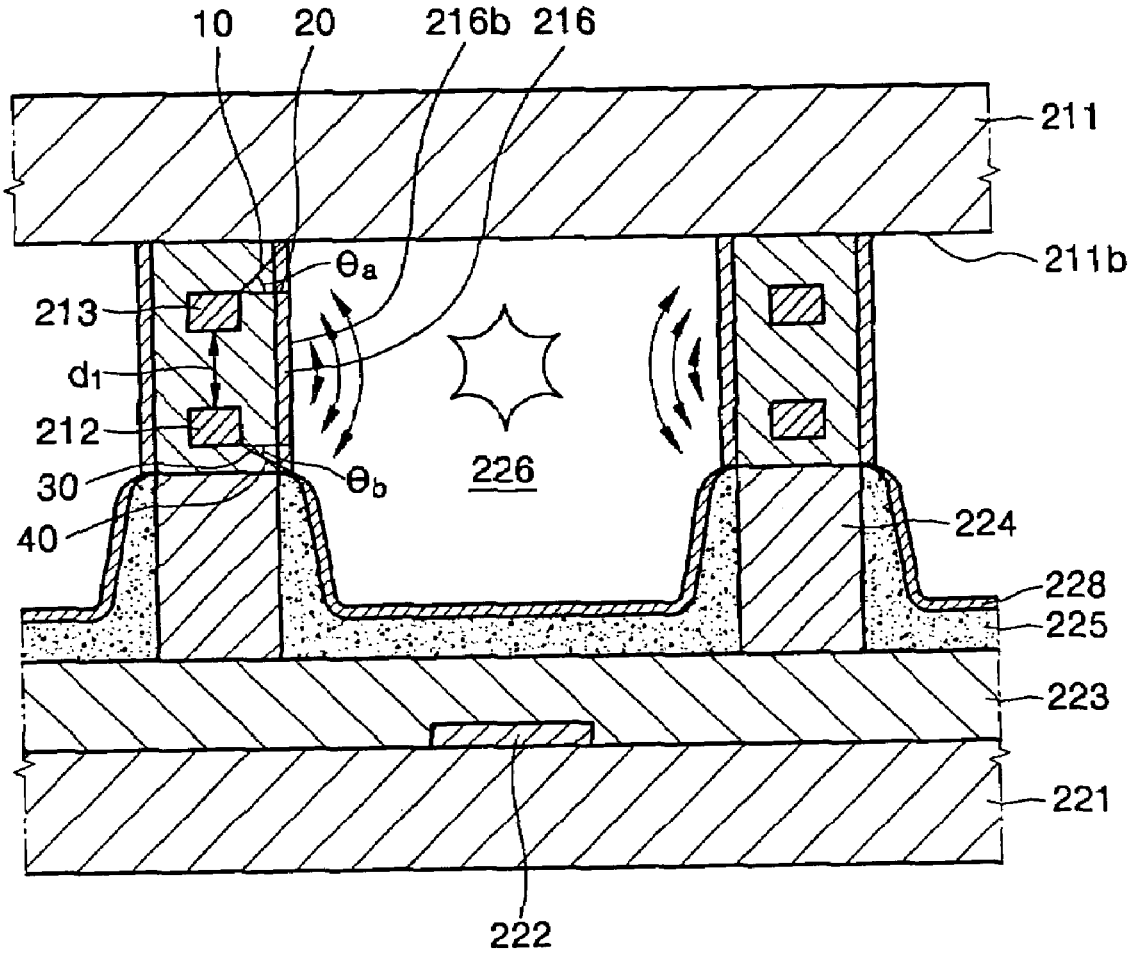
FIG. 7 is a cross-sectional view taken along line VII-VII of the PDP illustrated in FIGS. 3A and 3B.

FIG. 7 is a cross-sectional view taken along line VII-VII of the PDP illustrated in FIGS. 3A and 3B.

Referring to FIG. 7, the relationship between the angles $\theta_a$ and $\theta_b$ will now be described. As described above, the pulse potential applied between the front discharge electrode 213 and the rear discharge electrode 212 generates wall charge. This process is sequentially and repeatedly performed in the discharge cell 226. Thereafter, when the pulse potential is applied between the front discharge electrode 213 and the rear discharge electrode 212, the wall charge moves to collide with and excite the discharge gas, thereby generating discharge. Thus, the position in which the discharge is generated in the discharge cell 226 may be determined according to the position in which the wall charge is accumulated.

The position in which the wall charge is accumulated is determined according to the positions of the front discharge electrode 213 and the rear discharge electrode 212. If the front discharge electrode 213 and the rear discharge electrode 212 are positioned near the rear surface 211*b* of the front substrate 211, the probability that the discharge will occur near the front substrate 211 is increased. In this case, the discharge diffuses backward, and thus the probability that the discharge will occur in the entire discharge cell 226 is decreased. This implies that the discharge is decreased at a given drive voltage, and thus, the electrical efficiency is decreased.

By positioning the front discharge electrode 213 and the rear discharge electrode 212 so as to increase the probability that the discharge will occur in the central portion of the discharge cell 226, the discharge is more likely to fill the entire discharge cell 226. Thus, the amount of UV light generated by the discharge increases, and the amount of visible light generated by the fluorescent layer 225 increases, thereby increasing brightness of the PDP 200. As a result, since the drive voltage of the PDP 200 can be reduced while maintaining the required brightness, the electrical efficiency of the PDP 200 can be increased.

As described above, in order to increase the electrical efficiency, the front discharge electrode 213 and the rear discharge electrode 212 are positioned near the central portion of the discharge cell 226. In this case, as described above, since the range of a distance d1 between the front discharge electrode 213 and the rear discharge electrode 212 is limited, and the rear barrier rib 224 interposed between the front barrier rib 215 and the rear substrate 221 has a predetermined thickness, it is advantageous that the angle $\theta_a$ is greater than the angle $\theta_b$ such that the discharge occurs in the central portion of the discharge cell 226.

Figure 8:
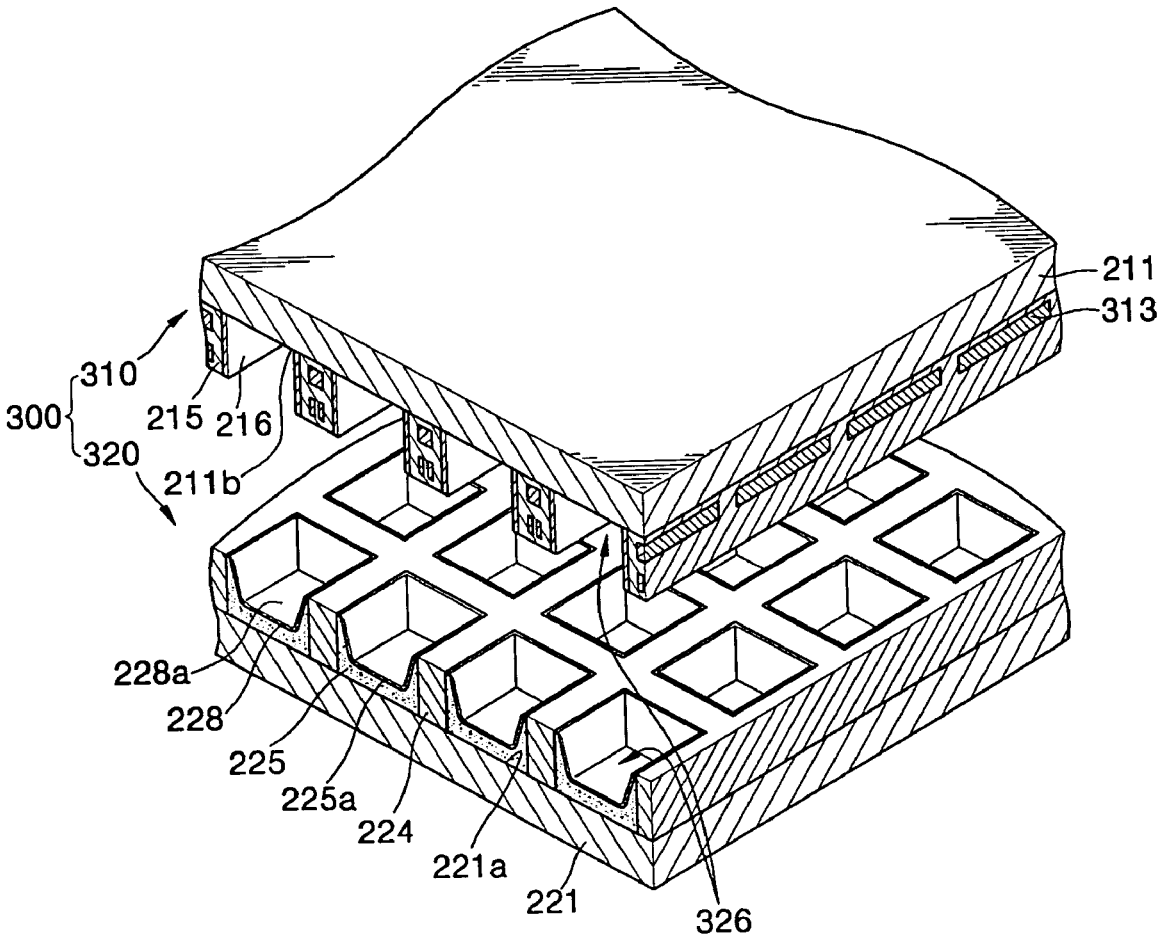
FIG. 8 is a cross-sectional view of a portion of a first modified example of the PDP according to an embodiment of the present invention.
Figure 9:
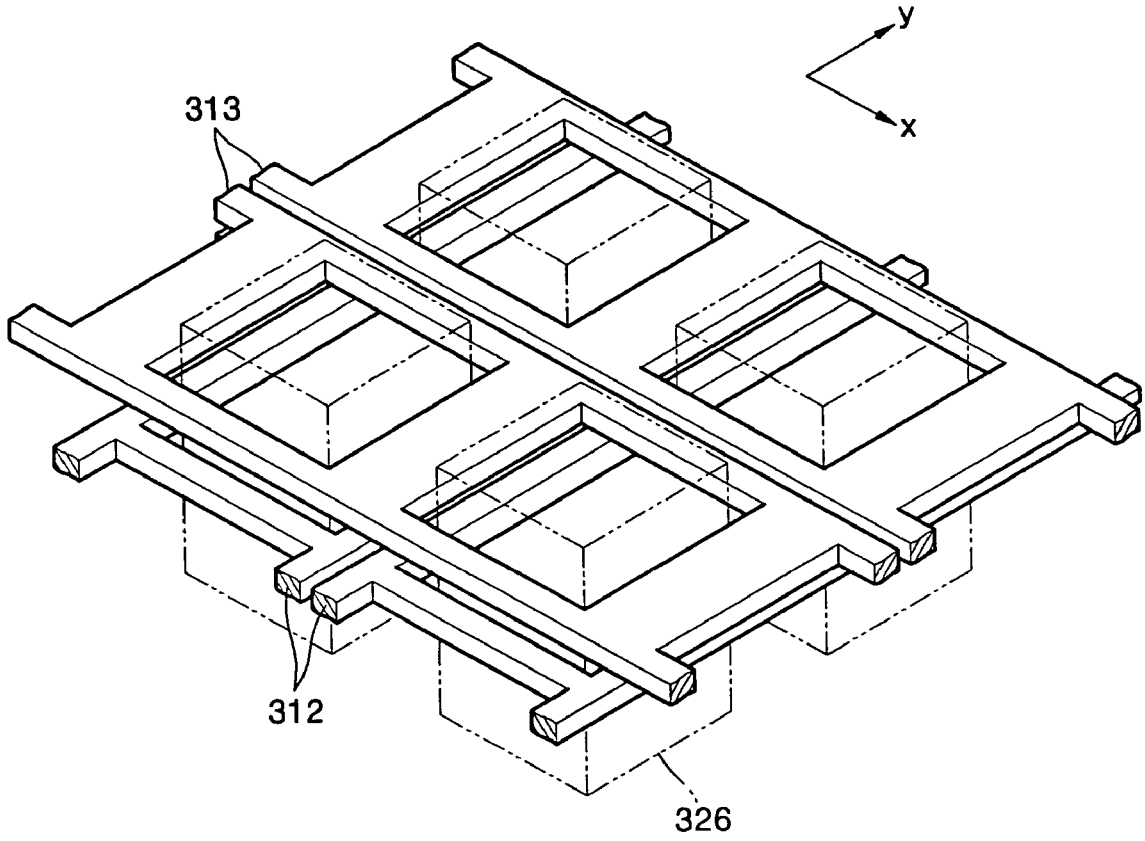
FIG. 9 illustrates front discharge electrodes, rear discharge electrodes, and discharge cells of the PDP illustrated in FIG. 8.

FIG. 8 is a cross-sectional view of a portion of a first modified example of the PDP according to an embodiment of the present invention, while FIG. 9 illustrates front discharge electrodes, rear discharge electrodes, and discharge cells of the PDP illustrated in FIG. 8.

Referring to FIGS. 8 and 9, the PDP 300 will be explained by concentrating on the points which differ from those of the PDP 200 illustrated in FIGS. 3A and 3B.

Referring to FIG. 8, the PDP 300 does not comprise address electrodes 222 which are present in the PDP 100 illustrated in FIG. 1. In the PDP 300, front discharge electrodes 313 and rear discharge electrodes 312 perform the functions of the address electrodes 222. Since the address electrodes 222 are not formed, the dielectric layer 223 covering the address electrodes 222 is not an essential component in the PDP 300.

Referring to FIG. 9, each of the front discharge electrodes 313 has a ladder shape and extends in the x-axis direction, and each of the rear discharge electrodes 312 has a ladder shape and extends in the y-axis direction, crossing the front discharge electrodes 313. The front discharge electrodes 313 and the rear discharge electrodes 312 are located in the front barrier ribs 215 so that they surround the discharge cells 326.

The operation of the PDP 300, which does not comprise address electrodes 222, will now be explained by concentrating on the points which differ from those of the PDP 200 illustrated in FIG. 3. In the PDP 300, one of the discharge cells 326 in which the discharge occurs is selected by causing discharge through the application of a potential to the front discharge electrodes 313 and the rear discharge electrodes 312 that intersect in the discharge cells 326 to be selected. The discharge generates wall charge on sidewalls of the discharge cell 326*s*, as described above. Thereafter, as described above, a sustain discharge occurs with the aid of the wall charge by applying a potential between the front discharge electrodes 313 and the rear discharge electrodes 312 sequentially. Such a procedure is selectively and repeatedly performed for the discharge cells 326 of the PDP 300, and thus an image is realized.

Figure 10A:
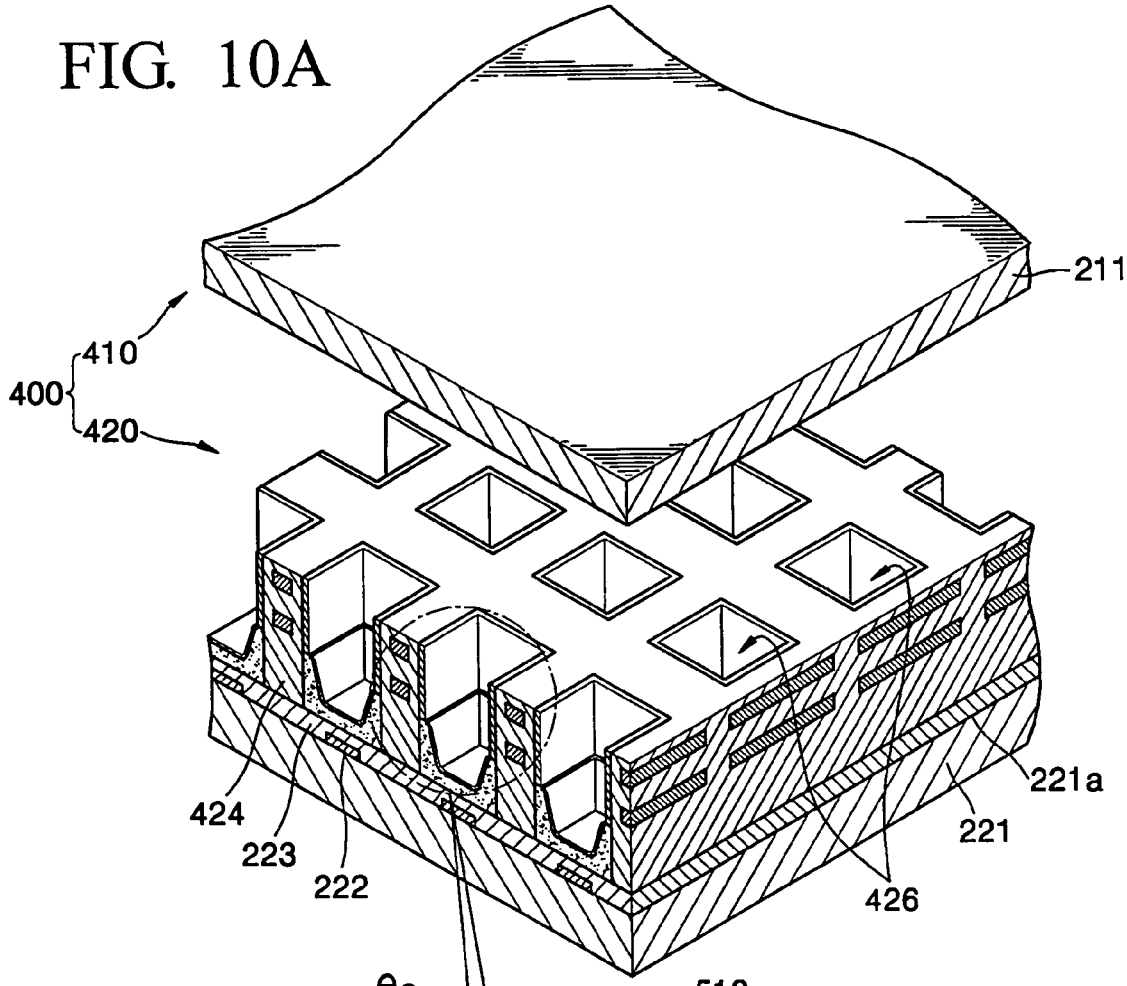
FIGS. 10A and 10B together form a cross-sectional view of a portion of a second modified example of the PDP according to an embodiment of the present invention.
Figure 10B:
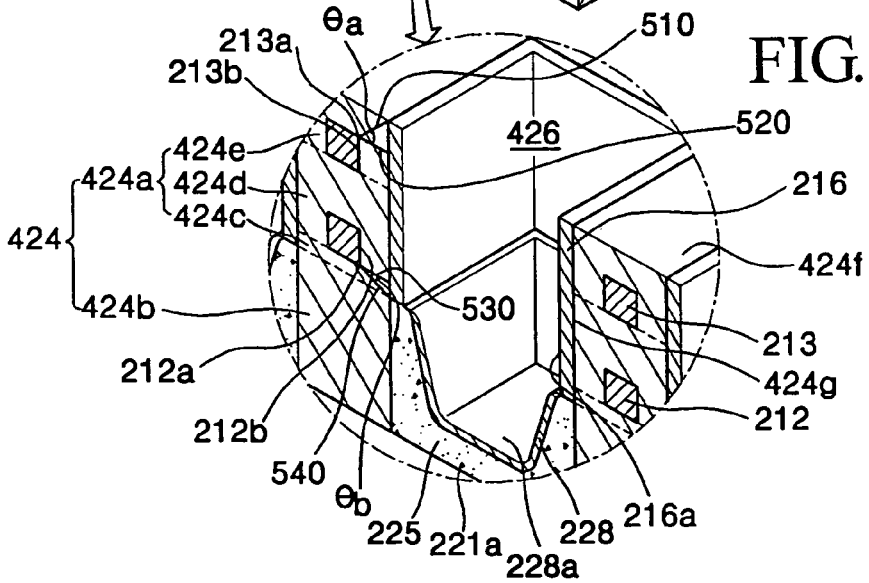

FIGS. 10A and 10B together form a cross-sectional view of a portion of a second modified example of the PDP according to an embodiment of the present invention.

Referring to FIG. 10A, the PDP 400 will be explained by concentrating on the points which differ from those of the PDP 200 illustrated in FIGS. 3A and 3B.

The PDP 400 differs from the PDP 200 illustrated in FIG. 3A in that integrated barrier ribs 424 in the PDP 400 replace the front barrier ribs 215 and the rear barrier ribs 224 in the PDP 200.

The integration of the front barrier ribs 215 and the rear barrier ribs 224 into the integrated barrier ribs 424 means that front barrier ribs 215 and the rear barrier ribs 224 are joined and cannot be separated without breaking, but it does not mean that the barrier ribs 424 are produced in one process.

The production of the integrated barrier ribs 424 will now be explained by an example with reference to FIGS. 10A and 10B.

Referring to the enlarged view of FIG. 10B, a rear portion 424*b* of a barrier rib 424 is formed on the front surface 221*a* of the rear substrate 222. Then, the space defined by the rear portion 424*b* is filled with a paste comprising a fluorescent material, and is dried and baked.

Next, a first barrier rib layer 424*c* is formed on the rear portion 424*b* of the integrated barrier rib 424, and a rear discharge electrode 212 is formed on the first barrier rib layer 424*c*. The first barrier rib layer 424*c* does not have to be formed when the rear discharge electrode 212 contacts the rear portion 424*b* which defines the space in which the fluorescent layer 225 is coated. Then, a second barrier rib layer 424*d* is formed to cover the rear discharge electrode 212, and a front discharge electrode 213 is formed on the second barrier rib layer 424*d*. A third barrier rib layer 424*e* is formed to cover the front discharge electrode 213. The first barrier rib layer 424*c*, the second barrier rib layer 424*d*, and the third barrier rib layer 424*e* constitute a front portion 424*a* of the integrated barrier rib 424. Each of the rear portion 424*b*, the first barrier rib layer 424*c*, the second barrier rib layer 424*d*, and the third barrier rib layer 424*e* may comprise more than one layer if necessary (for example, in order to increase their thicknesses).

After forming the integrated barrier rib 424, a protective layer 216 is formed on at least the sidewall 424*g* of the front portion 424*a* of the integrated barrier rib 424 using deposition. During the deposition of the protective layer 216, a rear protective layer 228 is also formed on the front surface 225*a* of the fluorescent layer 225. The function of the rear protective layer 228 is as described above.

During the deposition of the protective layer 216, a protective layer may be further formed on the front surface 424*f* of the integrated barrier rib 424. The protective layer formed on the front surface 424*f* does not adversely effect the operation of the PDP 400.

In the PDP 400, an angle $\theta_a$ corresponds to the angle $\theta_a$ in the PDP 200, and is defined as the angle between a first front line 510 and a second front line 520, wherein the first front line 510 is the shortest line connecting the front edge of the outer sidewall 216*a* of the protective layer 216 to the front edge 213*a* of the outer sidewall 213*b* of the front discharge electrode 213, and the second front line 520 is the shortest line connecting the outer sidewall 213*b* of the front discharge electrode 213 to the outer sidewall 216*a* of the protective layer 216. In addition, an angle $\theta_b$ corresponds to the angle $\theta_b$ in the PDP 200, and is defined as the angle between a first rear line 540 and a second rear line 530, wherein the first rear line 540 is the shortest line connecting the rear edge of the outer sidewall 216*a* of the protective layer 216 to the rear edge 212*a* of the outer sidewall 212*b* of the rear discharge electrode 212, and the second rear line 520 is the shortest line connecting the outer sidewall 212*b* of the rear discharge electrode 212 to the outer sidewall 216*a* of the protective layer 216.

When the protective layer 216 is not coated on the sidewall 424*g* of the integrated barrier rib 424, the angle $\theta_a$ is measured based on the sidewall 424*g* of the integrated barrier rib 424, in place of the outer sidewall 216*a* of the protective layer 216.

The PDP according to the present invention has the following effects.

First, the PDP according to the present invention has a structure in which discharge electrodes are located in barrier ribs surrounding discharge cells, unlike a PDP in which pairs of sustain electrodes are located in a front panel. The characteristic structure of the PDP according to the present invention avoids the need for a dielectric layer or a protective layer, etc. on the front panel through which visible light is transmitted. As a result, the PDP according to the present invention allows the visible light generated by fluorescent layers in the discharge cells to pass directly through a front substrate, thereby greatly increasing light transmittance.

Second, in some PDPs, the sustain electrodes which generate the discharge are located on the rear surface of the front substrate, and in order to allow the visible light generated by the fluorescent layers in the discharge cells to be transmitted through the front substrate, the majority of the sustain electrodes must be formed of ITO, which is very expensive and highly resistive. Thus, the drive voltage is increased and the production cost of such PDPs is high. Furthermore, since the high resistance of the ITO electrodes causes a voltage drop, images cannot be uniformly realized when the PDP is large. However, in the PDP according to the present invention, the discharge electrodes are located in the barrier ribs, and thus the discharge electrodes can be formed of a highly conductive material.

Third, in some PDPs, the sustain electrodes are formed on the rear surface of the front substrate, and the discharge occurs behind the protective layer in the discharge cells and diffuses within the discharge cells. Thus, luminous efficiency is reduced. When such a PDP is used for a long period of time, charged discharge gas induces ion sputtering of the fluorescent material due to the electric field, thereby resulting in permanent after-images. However, in the PDP according to the present invention, the discharge occurs on the entire sidewalls surrounding the discharge cells, and front discharge electrodes and rear discharge electrodes are positioned near the centers of the discharge cells such that the discharge is concentrated in the centers of the discharge cells. Rear protective layers coated on the front surfaces of the fluorescent layers can protect the fluorescent layers against the collision of some ions.

Fourth, in the PDP according to the present invention, the front discharge electrodes are separated from the front substrate by a predetermined distance, and an electric field angled from the edges of the front discharge electrodes generates wall charge on the outer sidewalls of the protective layers coated on the outer sidewalls of the front barrier ribs, thereby increasing the level of discharge and brightness. As a result, the drive voltage can be reduced while maintaining the required brightness, and the electrical efficiency of the PDP is increased. Also, a low voltage driving integrated circuit can be used, thereby reducing production cost of the PDP.

Fifth, in accordance with the invention, the front discharge electrodes and the rear discharge electrodes are optimally positioned such that the discharge can be efficiently generated. Thus, the efficiency of the PDP can be increased.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel (PDP), comprising:

a transparent front substrate;

a rear substrate disposed in parallel with the front substrate;

front barrier ribs made of a single dielectric material and located between the front substrate and the rear substrate so as to define discharge cells together with the front substrate and the rear substrate, with each of the discharge cells comprising not more than a single address electrode;

front discharge electrodes located in the front barrier ribs so as to surround the discharge cells, and separated from the front substrate;

rear discharge electrodes located in the front barrier ribs so as to surround the discharge cells, and separated from the front discharge electrodes;

rear barrier ribs located between the front barrier ribs and the rear substrate so as to define the discharge cells together with the front barrier ribs, the front substrate and the rear substrate;

fluorescent layers located in spaces defined by the rear barrier ribs and the rear substrate; and a discharge gas deposited in the discharge cells, with the front discharge electrodes are oriented to form an angle $\theta_a$ between a first front line and a second front line, $\theta_a$ being in a range of 0 degrees to 75 degrees, and the first front line being a shortest line connecting a front edge of an outer sidewall of one of the front barrier ribs to a front edge of an outer sidewall of one of the front discharge electrodes, and the second front line being a shortest line connecting the outer sidewall of said one of the front discharge electrodes to the outer sidewall of said one of the front barrier ribs.

2. The PDP of claim 1, wherein the front discharge electrodes are located such that the angle $\theta_a$ is in a range of 46 degree to 61 degree.

3. The PDP of claim 1, with the rear discharge electrodes being oriented to form an angle $\theta_b$ between a first rear line and a second rear line, $\theta_b$ being in a range of 0 degree to 61 degree, and with the first rear line being a shortest line connecting a rear edge of an outer sidewall of one of the front barrier ribs to a rear edge of an outer sidewall of one of the rear discharge electrodes, and the second rear line being a shortest line connecting the outer sidewall of said one of the rear discharge electrodes to the outer sidewall of said one of the front barrier ribs.

4. The PDP of claim 3, wherein the rear discharge electrodes are located such that the angle $\theta_b$ is in a range of 10 degree to 36 degree.

5. The PDP of claim 1, wherein the front discharge electrodes and the rear discharge electrodes are located such that an angle $\theta_a$ between a first front line and a second front line is not less than angle $\theta_b$ between a first rear line and a second rear line, wherein the first front line is a shortest line connecting a front edge of an outer sidewall of one of the front barrier ribs to a front edge of an outer sidewall of one of the front discharge electrodes, the second front line is a shortest line connecting the outer sidewall of said one of the front discharge electrodes to the outer sidewall of said one of the front barrier ribs, the first rear line is a shortest line connecting a rear edge of the outer sidewall of said one of the front barrier ribs to a rear edge of an outer sidewall of one of the rear discharge electrodes, and the second rear line is a shortest line connecting the outer sidewall of said one of the rear discharge electrodes to the outer sidewall of said one of the front barrier ribs.

6. The PDP of claim 1, further comprising rear protective layers located on the front surfaces of the fluorescent layers.

7. The PDP of claim 1, wherein the front discharge electrodes extend in a predetermined direction, and the rear discharge electrodes extend so as to cross the front discharge electrodes at the discharge cells.

8. The PDP of claim 1, wherein the front discharge electrodes and the rear discharge electrodes extend in a predetermined direction, and address electrodes extend so as to cross the front discharge electrodes and the rear discharge electrodes at the discharge cells.

9. The PDP of claim 1, further comprising address electrodes interposed between the rear substrate and the fluorescent layers, and a dielectric layer interposed between the fluorescent layers and the address electrodes.

10. The PDP of claim 1, wherein each of the front discharge electrodes and the rear discharge electrodes has a ladder shape, and at least outer sidewalls of the front barrier ribs are coated with a protective layer.

11. The PDP of claim 10, wherein the front discharge electrodes and the rear discharge electrodes are located such that an angle $\theta_a$ between a first front line and a second front line is in a range of 0 degree to 75 degree, an angle $\theta_b$ between a first rear line and a second rear line is in a range of 0 degree to 61 degree, and the angle $\theta_a$ is not less than the angle $\theta_b$, and wherein the first front line is a shortest line connecting a front edge of an outer sidewall of one of the front barrier ribs to a front edge of an outer sidewall of one of the front discharge electrodes, the second front line is a shortest line connecting the outer sidewall of said one of the front discharge electrodes to the outer sidewall of said one of the front barrier ribs, the first rear line is a shortest line connecting a rear edge of the outer sidewall of said one of the front barrier ribs to a rear edge of an outer sidewall of one of the rear discharge electrodes, and the second rear line is a shortest line connecting the outer sidewall of said one of the rear discharge electrodes to the outer sidewall of said one of the front barrier ribs.

12. The PDP of claim 11, wherein the front discharge electrodes and the rear discharge electrodes are located such that the angle $\theta_a$ is in a range of 46 degree to 61 degree, the angle $\theta_b$ is in a range of 10 degree to 36 degree, and the angle $\theta_a$ is not less than the angle $\theta_b$.

13. The PDP of claim 1, wherein the front barrier ribs and the rear barrier ribs are formed as an integrated body.

14. A plasma display panel (PDP), comprising:

a transparent front substrate;

a rear substrate disposed in parallel with the front substrate;

front barrier ribs made of a single dielectric material and located between the front substrate and the rear substrate so as to define discharge cells together with the front substrate and the rear substrate, with each of the discharge cells comprising not more than a single address electrode;

front discharge electrodes located in the front barrier ribs so as to surround the discharge cells, and separated from the front substrate;

rear discharge electrodes located in the front barrier ribs so as to surround the discharge cells, and separated from the front discharge electrodes;

rear barrier ribs located between the front barrier ribs and the rear substrate so as to define the discharge cells together with the front barrier ribs, the front substrate and the rear substrate;

fluorescent layers located in spaces defined by the rear barrier ribs and the rear substrate; and a discharge gas deposited in the discharge cells, with the rear discharge electrodes are oriented to form an angle $\theta_b$ between a first rear line and a second rear line, $\theta_b$ being in a range of 0 degrees to 61 degrees, and the first rear line being a shortest line connecting a rear edge of an outer sidewall of one of the front barrier ribs to a rear edge of an outer sidewall of one of the rear discharge electrodes, and the second rear line being a shortest line connecting the outer sidewall of said one of the rear discharge electrodes to the outer sidewall of said one of the front barrier ribs.

15. The PDP of claim 14, wherein the rear discharge electrodes are located such that the angle $\theta_b$ is in a range of 10 degree to 36 degree.

16. A plasma display panel (PDP), comprising:

a transparent front substrate;

a rear substrate disposed in parallel with the front substrate;

front barrier ribs made of a single dielectric material and located between the front substrate and the rear substrate so as to define discharge cells together with the front substrate and the rear substrate, with each of the discharge cells comprising not more than a single address electrode;

front discharge electrodes located in the front barrier ribs so as to surround the discharge cells, and separated from the front substrate;

rear discharge electrodes located in the front barrier ribs so as to surround the discharge cells, and separated from the front discharge electrodes;

rear barrier ribs located between the front barrier ribs and the rear substrate so as to define the discharge cells together with the front barrier ribs, the front substrate and the rear substrate;

fluorescent layers located in spaces defined by the rear barrier ribs and the rear substrate; and a discharge gas deposited in the discharge cells, with the front discharge electrodes and the rear discharge electrodes being oriented such that an angle $\theta_a$ between a first front line and a second front line is not less than angle $\theta_b$ between a first rear line and a second rear line, wherein the first front line is a shortest line connecting a front edge of an outer sidewall of one of the front barrier ribs to a front edge of an outer sidewall of one of the front discharge electrodes, the second front line being a shortest line connecting the outer sidewall of said one of the front discharge electrodes to the outer sidewall of said one of the front barrier ribs, the first rear line being a shortest line connecting a rear edge of the outer sidewall of said one of the front barrier ribs to a rear edge of an outer sidewall of one of the rear discharge electrodes, and the second rear line is a shortest line connecting the outer sidewall of said one of the rear discharge electrodes to the outer sidewall of said one of the front barrier ribs.

* * * * *